US010507683B2

(12) United States Patent
Harris

(10) Patent No.: US 10,507,683 B2
(45) Date of Patent: Dec. 17, 2019

(54) BINDER WITH EXTERNAL STORAGE CAPACITY

(71) Applicant: ACCO Brands Corporation, Lake Zurich, IL (US)

(72) Inventor: Richard H. Harris, Xenia, OH (US)

(73) Assignee: ACCO Brands Corporation, Lake Zurich, IL (US)

( * ) Notice: Subject to any disclaimer, the term of this patent is extended or adjusted under 35 U.S.C. 154(b) by 63 days.

(21) Appl. No.: 14/932,297

(22) Filed: Nov. 4, 2015

(65) Prior Publication Data

US 2016/0121643 A1 May 5, 2016

Related U.S. Application Data

(60) Provisional application No. 62/074,906, filed on Nov. 4, 2014.

(51) Int. Cl.
*B42F 13/26* (2006.01)
*B42F 13/00* (2006.01)

(52) U.S. Cl.
CPC ..... *B42F 13/26* (2013.01); *B42F 13/004* (2013.01); *B42F 13/0026* (2013.01); *B42P 2241/06* (2013.01); *B42P 2241/20* (2013.01)

(58) Field of Classification Search
CPC .... B42F 13/00; B42F 3/04; B42F 3/00; B42F 13/12
USPC ..... 402/26, 31, 35, 70, 73, 74, 75, 76, 77, 402/502
See application file for complete search history.

(56) References Cited

U.S. PATENT DOCUMENTS

| | | | | |
|---|---|---|---|---|
| 4,848,948 | A * | 7/1989 | Pitts | B42F 13/402 281/33 |
| 6,196,749 | B1 | 3/2001 | Chizmar | |
| 7,077,596 | B1 | 7/2006 | Bianco et al. | |
| 7,387,461 | B2 | 6/2008 | Brandt et al. | |
| 7,717,638 | B2 | 5/2010 | Harris et al. | |
| 8,033,747 | B2 | 10/2011 | Busam et al. | |
| 8,522,939 | B2 | 9/2013 | Rowe | |
| 2005/0238416 | A1* | 10/2005 | Chang | B42F 13/24 402/75 |
| 2007/0297849 | A1* | 12/2007 | Merzon | B42F 7/06 402/73 |
| 2009/0250918 | A1* | 10/2009 | Seidl | B42D 1/06 281/29 |

FOREIGN PATENT DOCUMENTS

| | | | | |
|---|---|---|---|---|
| GB | 2243807 | A * | 11/1991 | B42F 13/04 |

* cited by examiner

*Primary Examiner* — Justin V Lewis
(74) *Attorney, Agent, or Firm* — Fitch, Even, Tabin & Flannery LLP

(57) ABSTRACT

A binder device including a cover having a first panel and a second panel pivotally coupled together. The binder device further includes a binding mechanism coupled to an inner surface of the cover. The binder device is configured such that a first component is bindable to the binding mechanism and generally positioned between the first and second panels and a second component is simultaneously bindable to the binding mechanism and at least partially not positioned between the first and second panels.

40 Claims, 9 Drawing Sheets

BINDER WITH EXTERNAL STORAGE CAPACITY

This application claims priority to U.S. Provisional Patent Application Ser. No. 62/074,906, filed on Nov. 4, 2014, the entire contents of which are incorporated by reference herein.

BACKGROUND

Binders are typically used in home, office and school settings to provide portable storage devices for holding various contents. The binder can have an outer cover and a binding mechanism coupled to an inner surface of the outer cover. Various components, such as papers, pockets, dividers and the like can be bound to the binding mechanism and positioned in the outer cover. However, such binders may provide limited access to the bound components.

SUMMARY

In one embodiment, the present invention is a binder device which provides improved access to the bound components. More particularly, in one embodiment the invention is a binder device including a cover having a first panel and a second panel pivotally coupled together. The binder device further includes a binding mechanism coupled to an inner surface of the cover. The binder device is configured such that a first component is bindable to the binding mechanism and generally positioned between the first and second panels and a second component is simultaneously bindable to the binding mechanism and at least partially not positioned between the first and second panels.

DETAILED DESCRIPTION

Figure 1:
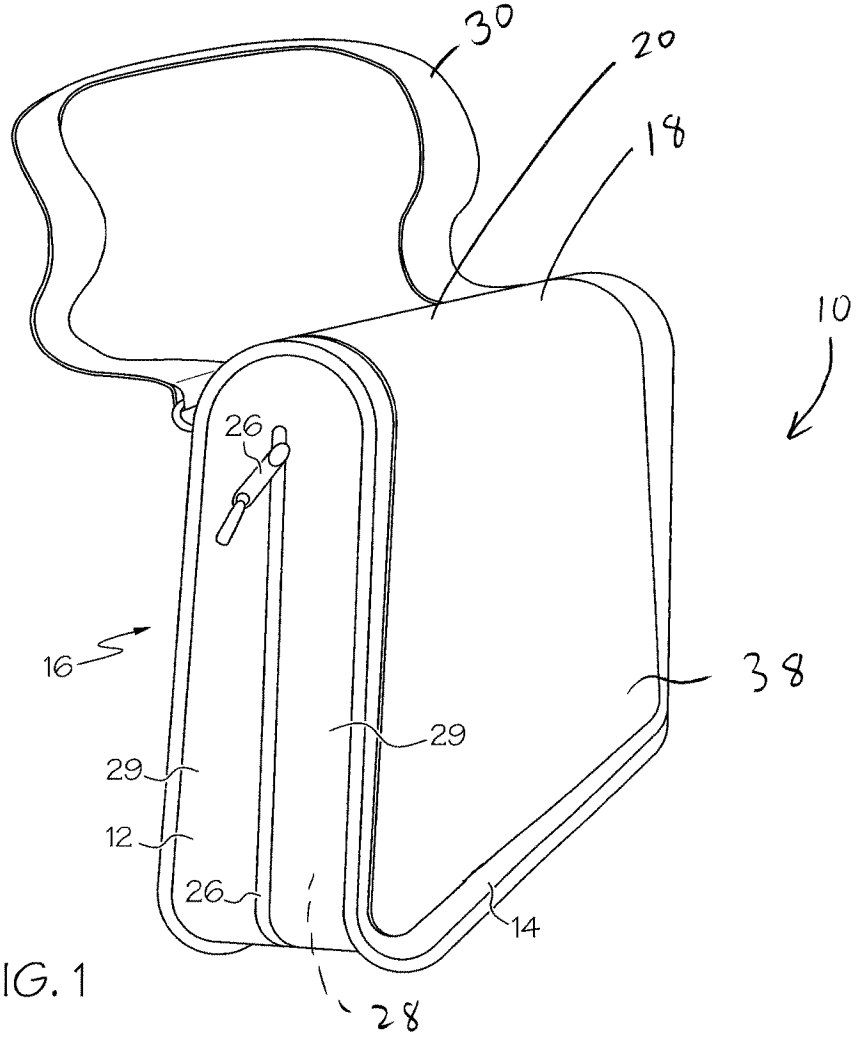
FIG. 1 is a front perspective view of one embodiment of the binder device, shown in its closed position and with the cover flap in its cover position.

As shown in FIGS. 1-6, a first embodiment of the binder device, generally designated 10, may include an outer cover, casing or outer casing 12 having a front or first cover or panel 14, a back or second cover or panel 16, and a spine panel or spine region 18 positioned therebetween. The front panel 14 and back panel 16 may each be pivotally coupled to the spine 18 along an associated hinge or fold line 20. However, in some cases there may be no clear line of demarcation between the panels 14, 16 and spine, such as in FIG. 3 where there is no clear line of demarcation between the front cover 14 and spine 18. However, the binder device 10 need not necessarily include the spine 18, in which case the panels 14, 16 can be directly pivotally coupled to each other and the joint/hinge line between the panels 14,16 can be considered the spine region 18/fold line 20. The binder device 10 can thus take the form of a binder, notebook, folder, folio, pocket, pocket divider, planner and the like.

The front panel 14, back panel 16 and spine 18 may each be made of a generally flat, planar material, in some cases with sufficient stiffness to retain their shape when the binder device 10 is stood upright/on end. The front panel 14, back panel 16 and spine 18 can be made of a variety of materials including but not limited to plastics or polymers materials, including PVC, polypropylene, polyethylene, polyethylene vinyl acetate (PEVA), easy-processing polyethylene (EPPE), or other materials such as fabric, leather, or cardboard, paper, polymer-covered cardboard or paper, etc. One or more pockets may be provided on the inner and/or outer surfaces of the front panel 14, back panel 16, and/or spine 18. The binder device 10 can include a strap 30 (FIG. 1) coupled to the outer cover 12 and positionable over the shoulder of a user such that the binder device 10 is carryable in the form of a courier bag.

The binder device 10 may also include a binding mechanism 22 (FIGS. 2-6) positioned on an inner surface of the outer cover 12. In the illustrated embodiment the binding mechanism 22 is positioned adjacent to the spine 18, although the binding mechanism 22 could be coupled to any of the panels 14, 16, 18.

In the illustrated embodiment the binding mechanism 22 takes the form of a three-ring binding mechanism or the like, including one or more binding rings 24 and having a binder mechanism length extending longitudinally/axially thereof. Each binding ring 24 may be separable into two separate ring halves or portions such that papers, pockets, dividers or other items can be placed into, or removed from, the binding mechanism 22. Each binding ring 24 may also be movable to a closed position, as shown in FIGS. 2-6 in which the ring halves engage each other and form a closed ring to trap the bound contents therein. The binding mechanism 22 may include one or more actuators 27 (FIG. 6) that are manually operable to move the binding rings 24 between the open and closed position such that the binding mechanism 22 can be manually operated to add or remove components therefrom.

It should be understood that the binding mechanism 22 can take any of a variety of other forms or configurations besides ring binding mechanisms shown herein, and can include or take the form of a coil or wire binding (including spiral and twin-wire bindings), clips, cords, ribbons, clamps, adhesives, book-style bindings, and combinations thereof, depending upon manufacturing preferences. In one case, however, the binding mechanism 22 is manually operable such that components to be bound can be manually added to and/or removed from the binding mechanism 22. The binding mechanism 22 may also take the form of the manually operable binding mechanism shown in U.S. Pat. No. 7,717,638, the entire contents of which are hereby incorporated by reference. The front panel 14, back panel 16 and/or spine 18 are not bound to/by the binding rings 24 of the binding mechanism 22 in the illustrated embodiment. In addition components to be bound to the binding mechanism 22 can in some cases be added to or removed from the binding mechanism 22 through the use of quick-connect couplings without having to open and close the binding rings 24.

In the illustrated embodiment, the front 14 and back 16 panels are generally rectangular and are coupled to the spine 18 along one edge thereof. The front 14 and back 16 panels also can each include a gusset 29. The front and back panels 14, 16 (and/or their gussets 29) can be releasably attachable together along their outer three edges by a closure mechanism 26, such as a zipper/zipper track, to close or define an inner compartment 28 positioned between the front 14 and back 16 panels, particularly when the binder device 10 is in a closed position wherein the front 14 and back 16 panels are generally parallel and aligned, as shown in FIG. 1. In one case the binding mechanism 22 is entirely positioned in the inner compartment 28. Thus in the illustrated embodiment the closure mechanism 26 extends around the entire perimeter of the free edges of the front 14 and back 16 panels, although the closure mechanism 26 can extend less than the entire perimeter, and may for example extend only along part of one side/edge thereof. Moreover the front 14 and back 16 panels need not necessarily be releasably attachable together, in which case the inner compartment 28 may be relatively open and accessible.

Figure 2:
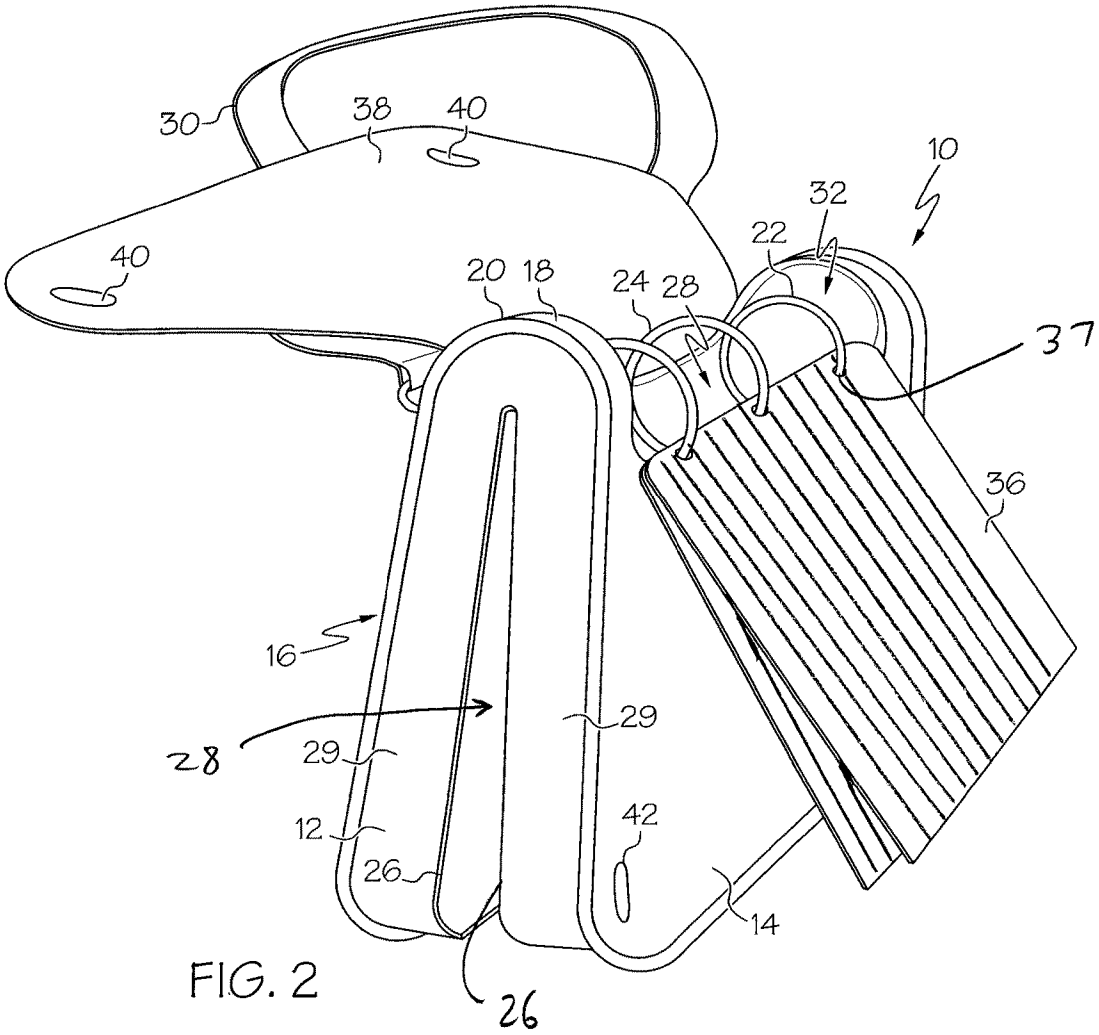
FIG. 2 is a front perspective view of the binder device of FIG. 1, shown in a slightly open position, with the cover flap in its refracted position, and with external bound components pivoted partially away from a body of the binder device.

The outer cover 12 can have an opening 32 formed therein that is aligned with or generally aligned with the binding mechanism 22, exposing and/or providing access to the binding mechanism 22. In particular, in the illustrated embodiment the opening 32 is positioned between the front 14 and back 16 panels, and positioned in or adjacent to the spine/spine region 18 and/or the inner portions of the front 14 and/or back 16 panels. In one embodiment the opening 32 has a size and/or length (extending parallel to the binding mechanism 22) at least equal to a size and/or (axial) length of the binding mechanism 22 (or at least the ring portions 24) such that the binding mechanism 22 (or at least the ring portions 24) is entirely revealed and directly accessible from outside the inner compartment 28/outer cover 12 when the binder device 10 is closed (or nearly closed, as shown in FIG. 2). The opening 32 can be positioned between the front 14 and back 16 panels, at their base ends opposite their free distal ends. The opening 32 can have any of a variety of shapes and sizes, and in the illustrated embodiment is generally rectangular and internally positioned in the outer cover 12, entirely spaced away from a perimeter of the outer cover and/or the panels 14, 16.

Figure 3:
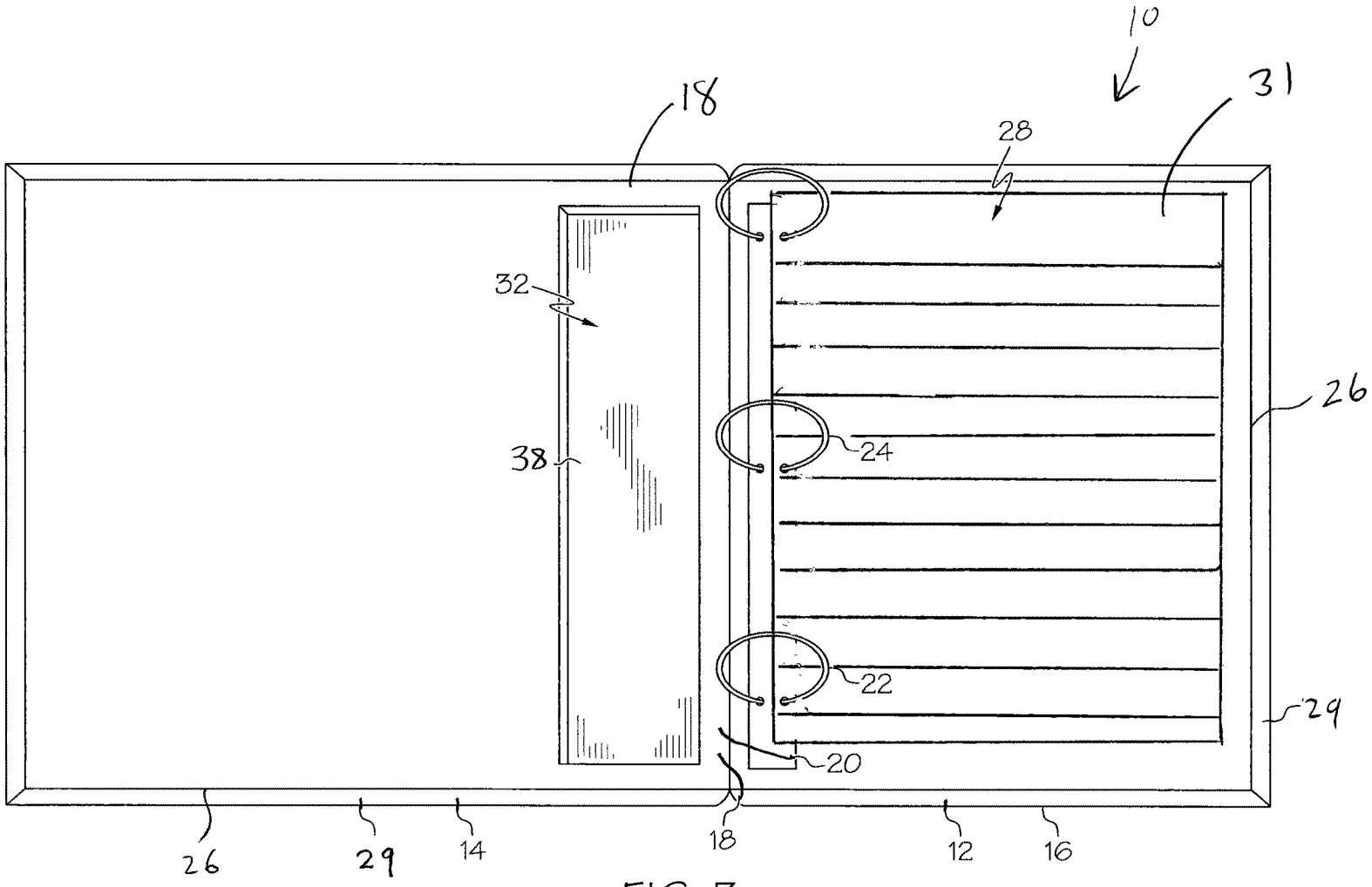
FIG. 3 is a top view of the binder device of FIG. 1 shown in its open position, without any external bound components but with an internal bound component.

As shown in FIG. 3, the binder device 10 and binding mechanism 22 are configured such that a first or inner component 31, such as a sheet of paper, pocket, divider or the like can be bound by the binding mechanism 22. The binder device 10 is movable to a closed configuration, as shown in FIG. 1, where the front 14 and back 16 panels are generally parallel, aligned, and overlapping in a thickness direction of the binder device 10, and the closure mechanism 26 may be closed. In this configuration the inner bound component 31 is positioned in the inner compartment 28, between the front 14 and back 16 panels, and generally protected and not accessible and/or not removable while the binder device 10 is closed.

The opening 32 allows limited external access to the binding mechanism 22 when the binder device 10 is in its closed configuration. The opening 32 thus enables a second or outer or external bound component 36, such as a sheet of paper, pocket, divider or the like, to be bound by the binding mechanism 22 while the external component 36 is positioned outside or generally outside the inner compartment 28, as shown in FIG. 2. Thus, in this configuration the external component 36 is positioned externally of or generally externally of the inner compartment 28, and is not positioned between the front 14 and back 16 panels, while the inner component 31, if utilized, can be simultaneously bound to the binding mechanism 22. Thus the binder device 10 need not be opened to access the external component 36 and/or bind the external component 36 thereto, thereby providing quick and convenient access to the external component 36.

The binder device 10/outer cover 12 can also include a pivotable cover flap or panel 38 to provide some protection to the external bound component 36 and/or binding mechanism 22 and/or inner compartment 28. In the illustrated embodiment the cover flap 38 is pivotally coupled the outer casing 12/back panel 16, and is pivotable between a retracted position (FIG. 2) wherein the cover flap 38 exposes and does not cover the opening 32 and/or the external component(s) 36, and a cover position (FIG. 1) wherein the cover flap 38 covers and does not expose the opening 32 and/or the external component(s) 36. When in the cover position the cover flap 38 can fully or partially overlay, cover and protect the external component(s) 36, and the external component(s) 36 is positioned between the cover flap 38 and the front panel 14. When in the cover position the cover flap 38 can and/or covers all or substantially all (in one case about 90% of the surface area) of the opening 32 and/or front cover 14. In one case the cover flap 38 has a size and shape about equal to (i.e. within at least about 90% by surface area) the front cover 14 so that the cover flap 38 can cover all or substantially all of the external component(s) 36 and/or opening 32.

The cover flap 38 can be releasably attachable to front panel 14. In particular the cover flap in FIG. 2 includes patches 40 of hook-and-loop fastening material, such as VELCRO® material, that are configured to releasably engage corresponding patches 42 of hook-and-loop fastening material on the front panel 14. However, any of a wide variety of other structures and devices can be utilized to secure the cover flap 38 to the front panel 14 including hooks, snaps, cords, ties, straps, clasps, inter-engaging features, magnets, etc.

Figure 4:
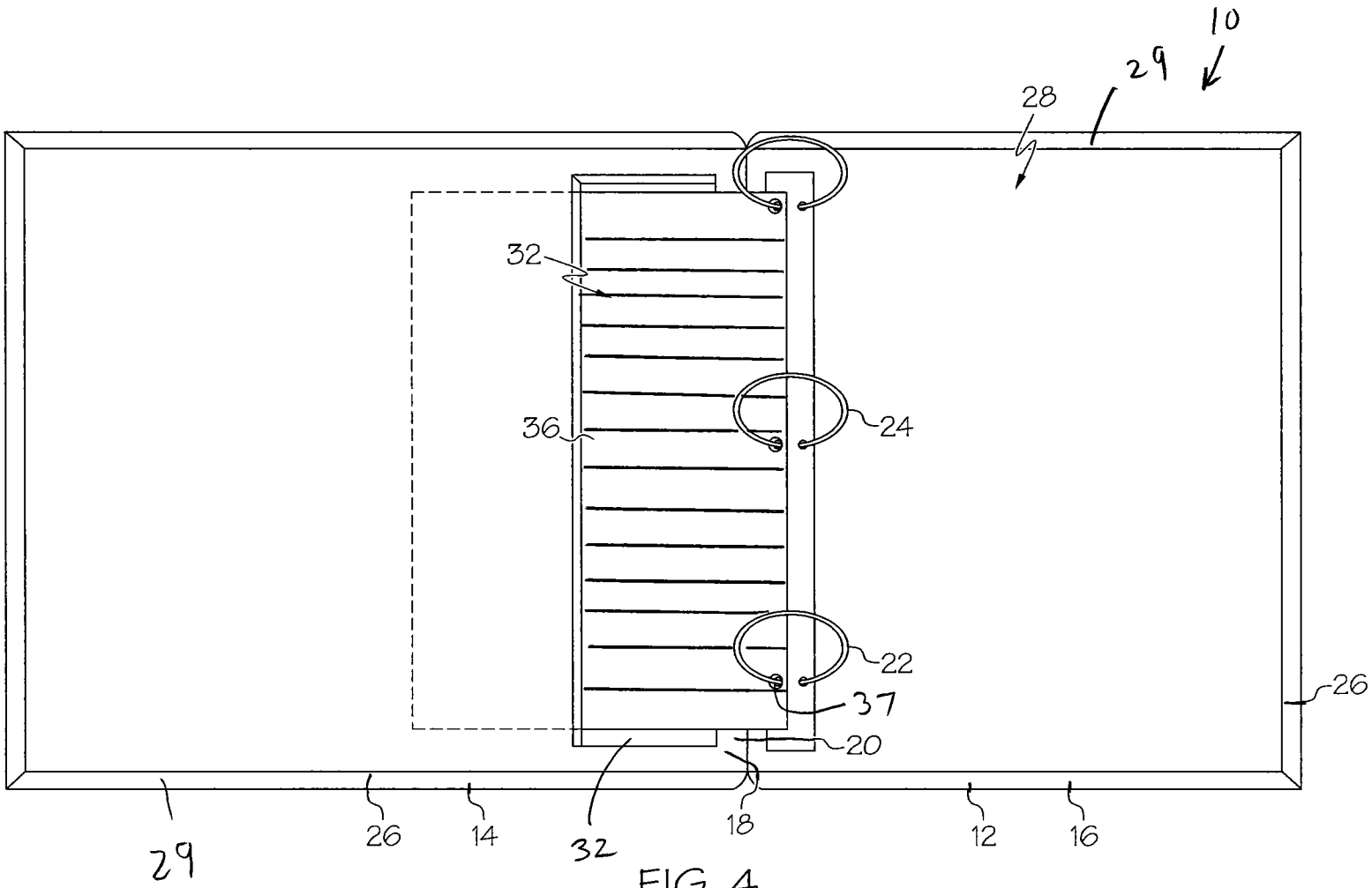
FIG. 4 is a top view of the binder device of FIG. 3, with a relatively short external bound component bound to the rings.

FIG. 4 is an interior view of the binder device 10 with an external bound component 36 bound to the binding mechanism 22, where at least part of the external component 36 is positioned outside the inner compartment 28. In particular, while some or much of the external component 36 is external to the inner compartment 28, an inner part of the external component 36 extends through the opening 32 and is positioned inside the inner compartment 28 and bound to the binding mechanism 22. In the case shown in FIG. 4, the external component 36 has a height, extending in the vertical direction in FIG. 4 and parallel to the binding mechanism 22, that is less than a height of the opening 32. In this case the external component 36 can easily pass through the opening 32, regardless of whether the binder device 10 is in its open or closed position. In one case the external component 36 can have the same, or generally the same, size and shape as the internal component 31.

Figure 5:
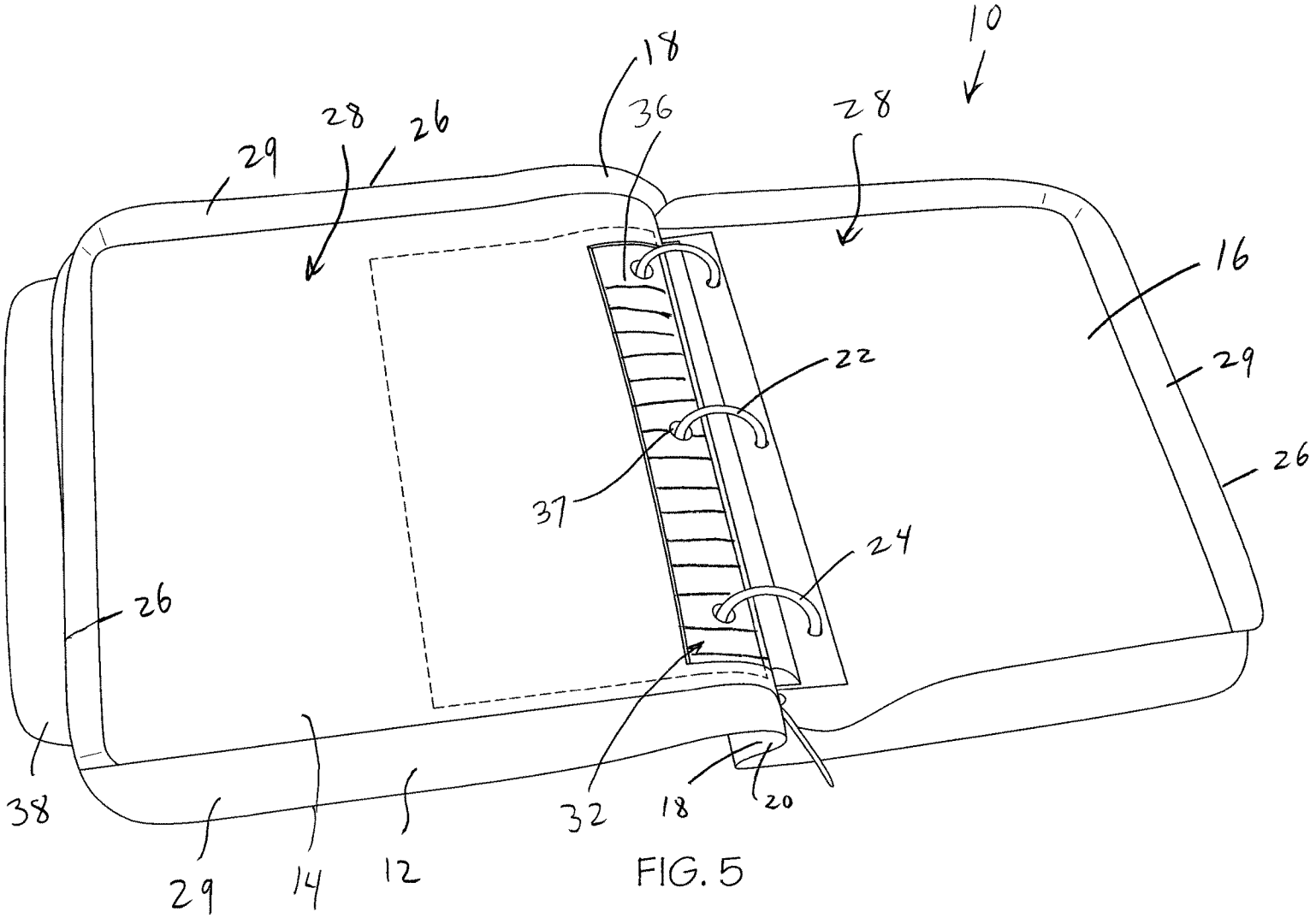
FIG. 5 is a top perspective view of the binder device of FIG. 3, with a relatively long external bound component bound to the rings.
Figure 6:
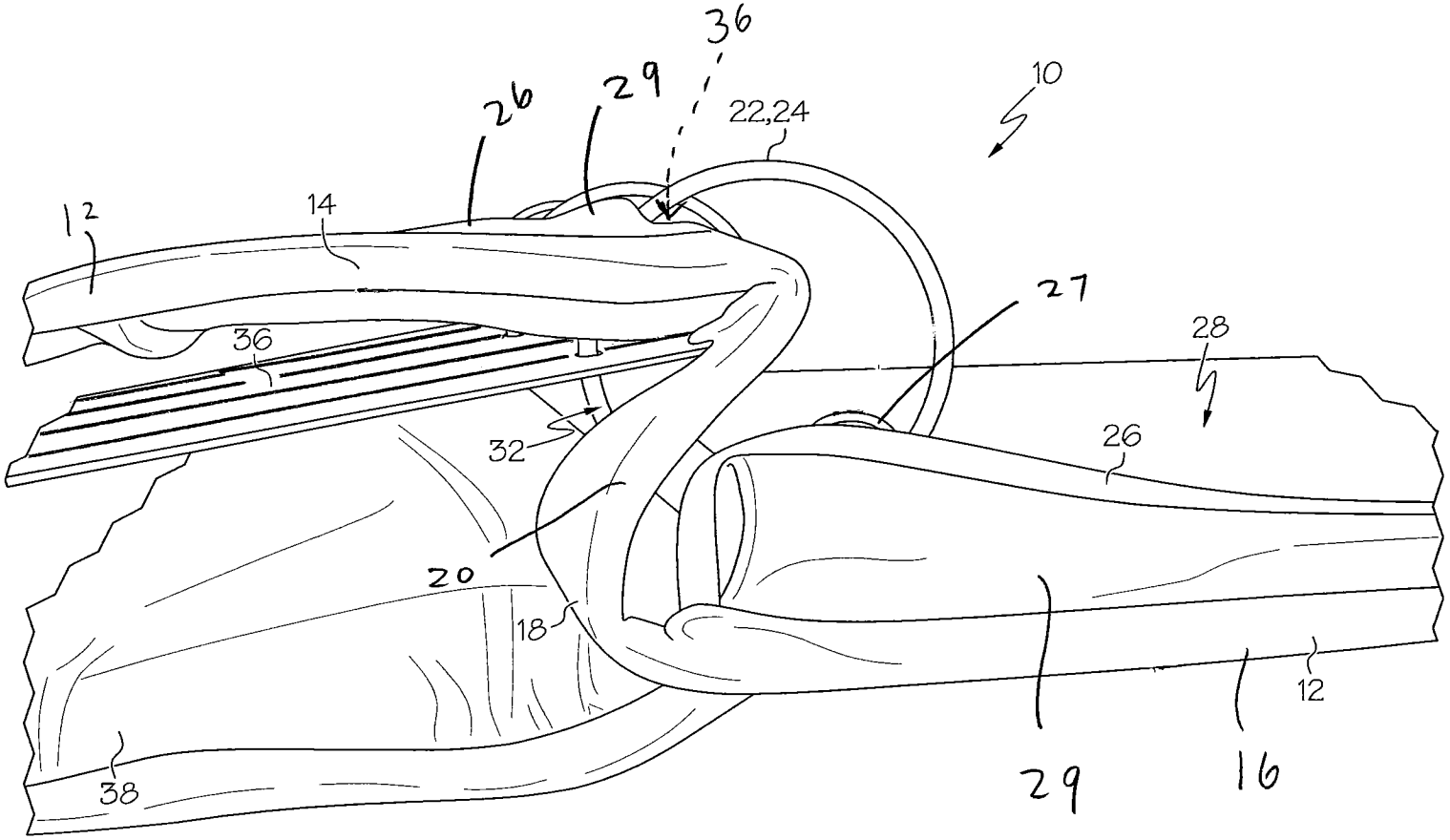
FIG. 6 is an end view of the binder device of FIG. 5.

In some cases, however, the external component 36 may have a height that is greater than a height of the opening 32. In this case the external component 36 may be able to be relatively easily coupled to the binding mechanism 22 when the binder device 10 is in its closed position, since the opening 32 is naturally aligned with the binding mechanism 22, as shown in FIG. 2. However, when the binder device 10 is in its open position, as shown in FIG. 3, the opening 32 may not be naturally aligned with the binding mechanism 22. Accordingly, in order to enable the external component 36 to pass through the opening 32 and be bound to the binding mechanism 22 when the external component 36 has a height greater than the height of the opening 32 and when the binder device 10 is in its closed position, the outer casing 12, and in particular the spine 18 and/or other portions of the outer casing 12, may be made of a sufficiently flexible material to enable outer casing 12 to flex and deform. In particular, as shown in FIGS. 5 and 6, the outer casing 12/spine 18 may be sufficiently flexible to bend/fold over itself two times and assume a generally "Z" shape (or generally "S" shape) in end view.

This flexing/folding of the outer casing 12 enables the opening 32 to be shifted closer to the binding mechanism 22 (e.g. to the right from its position shown in FIG. 3) to enable the rings 24 to be received through the openings 37 of the external component 36. In other words, the flexible nature of the outer casing 12 enables binder device 10 to be moved to an open, laid-flat position (wherein the front 14 and back 16 panels are generally co-planar and adjacent to each other, and not generally fully overlapping in a thickness direction of the binder device 10, as shown in FIGS. 3-6), while allowing the front panel 14 to be positioned above and spaced apart from the cover flap 38 to allow the external bound component 36 to be positioned therebetween. The flexibility of the outer casing 12 enables the front panel 14 to lie generally flat and parallel with the cover flap 38, and overlap with the cover flap 38 in a thickness direction of the binder device 10, when in this configuration.

Figure 7:
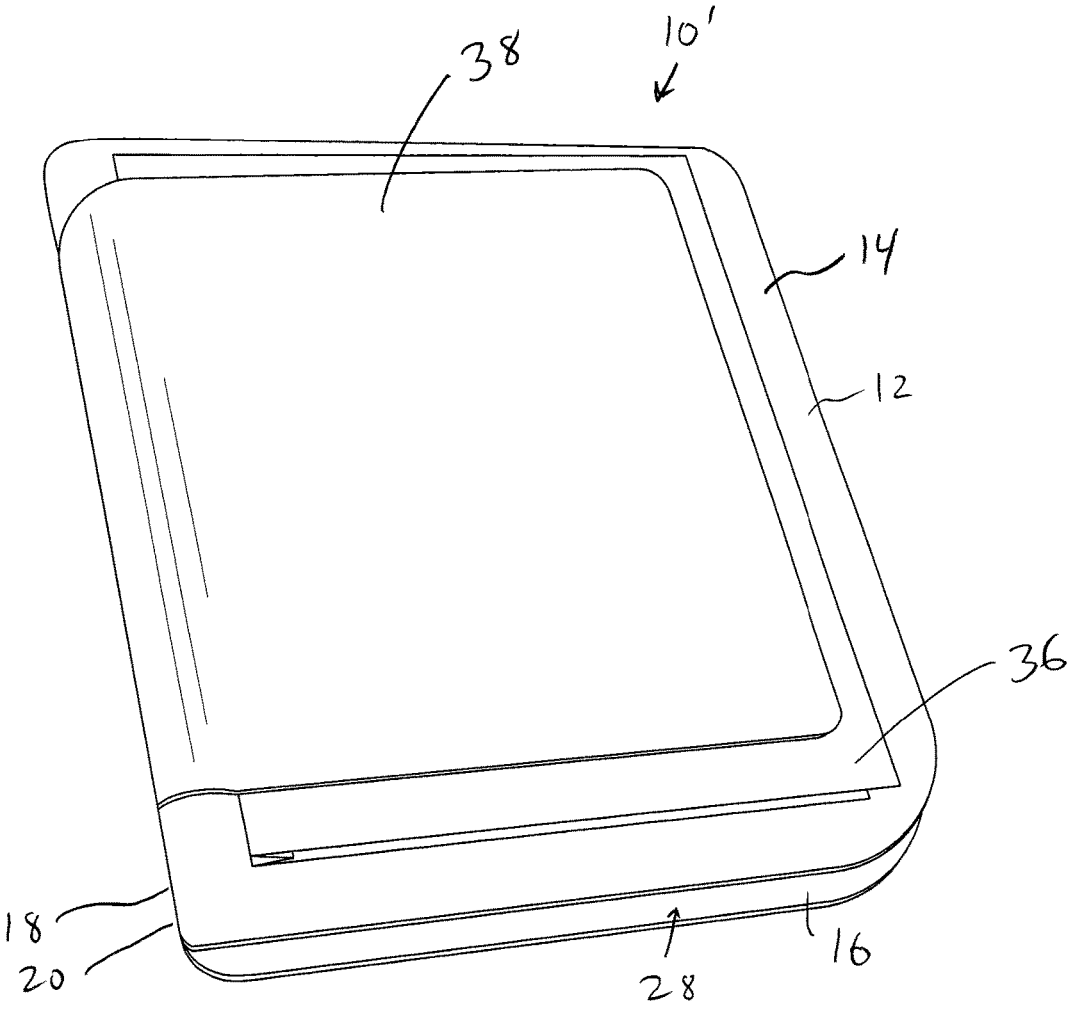
FIG. 7 is an upper perspective view of another embodiment of the binder device, shown in its closed position and with the cover flap in its cover position, and with an external bound component.
Figure 8:
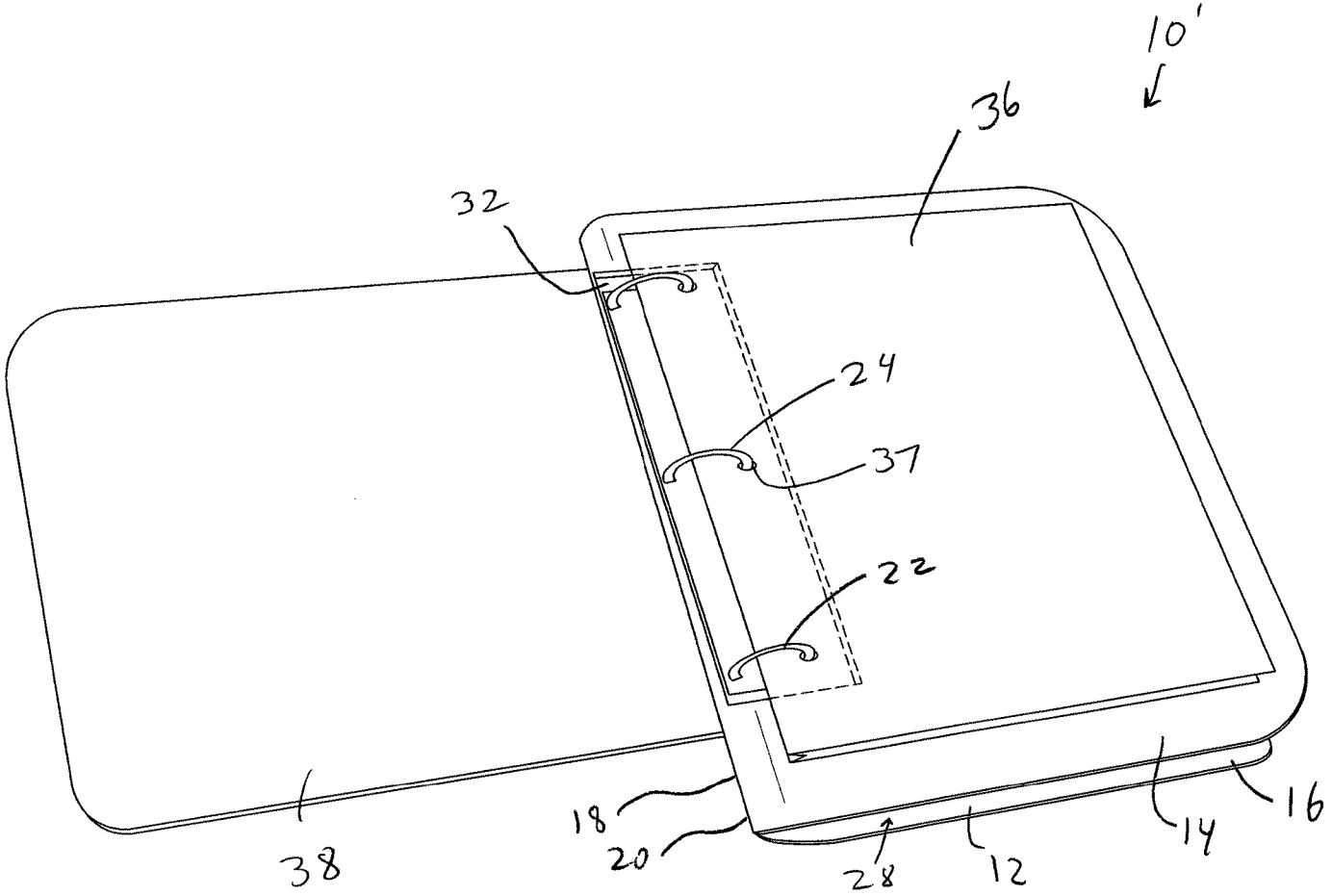
FIG. 8 is an upper perspective view of the binder device of FIG. 7, with the cover flap in its retracted position.
Figure 9:
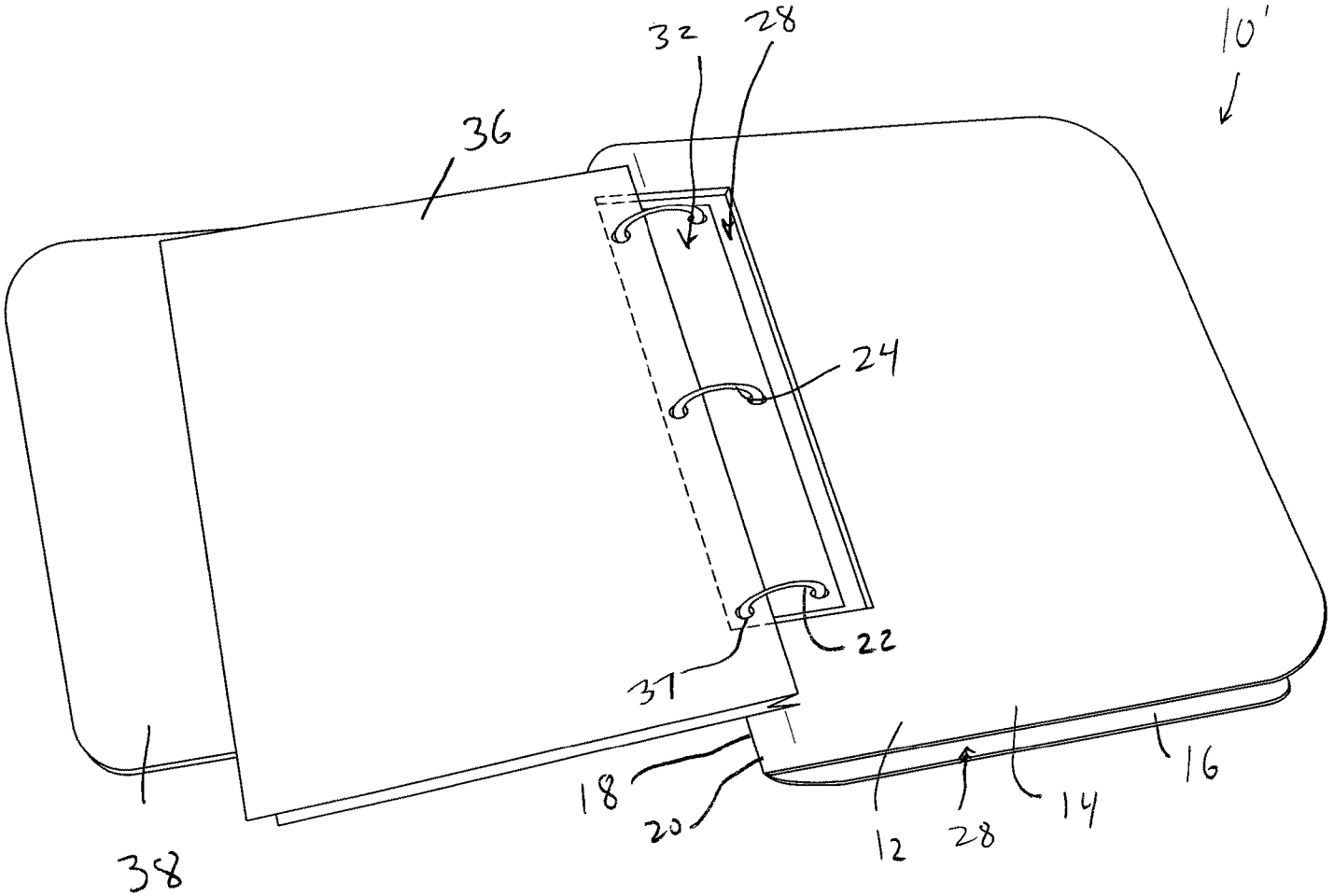
FIG. 9 is an upper perspective view of the binder device of FIG. 8, with the external bound component pivoted from its position shown in FIG. 8.

FIGS. 7-9 illustrate another embodiment of the binder device, generally designated 10' which functions in a similar manner to the binder device 10 of FIGS. 1-6. In the embodiment of FIGS. 7-9 the front 14 and back covers 16 lack the gussets 29 of the embodiment of FIGS. 1-6, and thus the front 14 and back 16 covers may not be directly attachable to each other about their perimeters. Also in this embodiment the cover flap 38 has a smaller surface area than the external component 36, and the external component 36 take the form of a folder, filer or the like. As shown in FIG. 9, when the cover flap 38 is retracted, access is provided to the binding mechanism 22/rings 24 by the opening 32, and as shown in FIG. 9 the external bound component 36 is pivotable about the rings 24. The embodiment of FIGS. 7-9 may also have sufficient flexibility to enable the binder device 10' to assume the configuration of the binder device 10 shown in FIGS. 5 and 6 as needed.

The binder device 10, 10' disclosed herein thus enables an external component 36 that is bound by the binding mechanism 22 to be positioned outside the inner compartment 28, and therefore available for quick and easy inspection and use. In other words, when it is desired to view and/or access such an external component 36, the binder device 10 does not need to be opened and the inner compartment 28 does not need to be accessed. In addition, the cover flap 38, if utilized, protects the external component 36 from damage, and is quickly and easily lifted out of the way, particular if the binder device 10 is worn over the shoulder of a user via strap 30 in the manner of a courier-type bag. At the same time, internal components 31 which are desired to be more securely bound and protected can be bound by the binding mechanism 22 and positioned in the inner compartment 28.

Having described the invention in detail and by reference to the various embodiments, it should be understood that modifications and variations thereof are possible without departing from the scope of the invention.

What is claimed is:

1. A binder device comprising:

a cover including a first panel and a second panel pivotally coupled together about a pivot axis, the cover including a continuous opening having a depth dimension extending perpendicular to said pivot axis; and a binding mechanism coupled to an inner surface of said cover and having at least two rings or coils, wherein said opening spans said at least two rings or coils when said cover is in a closed position, and wherein said depth dimension of said opening is greater than a largest depth dimension of each of said at least two rings or coils.

2. The binder device of claim 1 wherein said opening is configured and positioned to provide direct access to said binding mechanism from outside said cover.

3. The binder device of claim 1 wherein said opening is positioned between said first panel and said second panel opposite distal edges of said first panel and said second panel.

4. The binder device of claim 1 wherein said opening is configured and positioned to provide direct access to said binding mechanism from outside said cover when said cover is in said closed position wherein said first and second panels are generally parallel and aligned.

5. The binder device of claim 1 wherein said opening is entirely positioned in and formed through one of said first or second panels.

6. The binder device of claim 1 wherein said first and second panels are pivotally coupled together in a spine region of said binder device, and wherein said opening is positioned in or adjacent to said spine region to provide access to said binding mechanism.

7. The binder device of claim 6 wherein said binding mechanism has a length extending longitudinally thereof along a longest outer dimension of said binding mechanism, and wherein said opening has a length at least as long as said length of said binding mechanism.

8. The binder device of claim 1 wherein both said first panel and said second panel are not bound to said binding mechanism.

9. The binder device of claim 1 further comprising a cover flap pivotally coupled to said cover, wherein said cover flap is positionable to at least partially overlay said opening.

10. The binder device of claim 9 wherein said cover flap has generally the same size and shape as one of said first or second panels, and at least part of said cover flap is releasably attachable to said cover.

11. The binder device of claim 1 further comprising a closure mechanism, wherein the first and second panels each have an outer perimeter and are directly releasably attachable together at or adjacent to least part of their outer perimeters by said closure mechanism.

12. The binder device of claim 1 wherein said binding mechanism is manually operable such that bound components can be manually bound to or manually removed from said binding mechanism.

13. The binder device of claim 1 wherein a portion of said cover adjacent said opening is sufficiently flexible such that said portion is manually bendable into a "S" or "Z" shape in end view.

14. The binder device of claim 13 wherein said portion of said cover is sufficiently flexible to enable said binder device to be moved to an open, laid-flat position wherein the first and second panels are generally co-planar and adjacent to each other, and generally non-overlapping in a thickness direction of the binder device, while allowing a second component having a length longer than a length of said opening to be bound to said binding mechanism.

15. The binder device of claim 1 wherein said binder device is configured such that a first component is bindable to said binding mechanism and generally positioned between said first and second panels and a second component is simultaneously bindable to said binding mechanism and at least partially not positioned between said first and second panels.

16. The binder device of claim 1 wherein said at least two rings or coils are spaced apart in a longitudinal direction extending parallel to said pivot axis.

17. The binder device of claim 1 wherein said first panel and said second panel each have at least a partial bound edge oriented generally parallel to said pivot axis and positioned adjacent to said binding mechanism, and a distal edge oriented generally parallel to said pivot axis and positioned further from said binding mechanism than an associated bound edge, wherein said at least partial bound edge of said first panel and said at least partial bound edge of said second panel are permanently coupled together.

18. The binder device of claim 1 wherein said largest depth dimension of each of said at least two rings or coils extends in a direction parallel to said depth dimension of said opening, and wherein each ring or coil is generally circular in end view, and wherein said greatest depth dimension of each of said at least two rings or coils is a diameter of said ring or coil.

19. The binder device of claim 1 wherein said first and second panels are pivotally coupled together in a spine region, and wherein the binder device further includes a cover flap pivotally coupled to said cover in said spine region, wherein said cover flap is positionable to entirely overlay said opening.

20. A binder device comprising:

a cover including a first panel and a second panel pivotally coupled together; and a binding mechanism including a plurality of rings or coils coupled to an inner surface of said cover, wherein said cover includes a continuous opening that is aligned with said binding mechanism when said cover is in a closed position to provide access to said binding mechanism from outside said cover, wherein said opening is sized and configured to allow an entirety of said plurality of rings or coils to pass therethrough.

21. The binder device of claim 20 wherein said binder device is configured such that, when in said closed configuration, a first component is bindable to said binding mechanism and positioned between said first and second panels and a second component having a shape and size identical to a shape and size of said first component is receivable through said opening to be simultaneously bindable to said binding mechanism while at least part of said second component is not positioned between said first and second panels.

22. The binder device of claim 20 wherein said opening is entirely internally positioned in one of said first or second panels to thereby provide access to said binding mechanism from outside said cover through said opening.

23. The binder device of claim 20 wherein the first and second panels are pivotally coupled in a spine region of said binder device, and wherein said opening is positioned in or adjacent to said spine region.

24. The binder device of claim 20 wherein said opening is configured and positioned to provide direct access to said binding mechanism from outside said cover when said cover is in said closed position wherein said first and second panels are generally parallel and aligned.

25. The binder device of claim 20 wherein said first panel and said second panel are pivotal relative to each other about a pivot axis, and wherein said first panel and said second panel each have a bound edge oriented generally parallel to said pivot axis and positioned adjacent to said binding mechanism, and a distal edge oriented generally parallel to said pivot axis and positioned further from said binding mechanism than the associated bound edge, and wherein at least part of said bound edge of said first panel and at least part of said bound edge of said second panel are permanently coupled together.

26. The binder device of claim 20 wherein said opening is positioned in part of both said first panel and said second panel.

27. The binder device of claim 20 wherein the first and second panels are coupled along a physical hinge line formed in said cover, and wherein at least part of said hinge line intersects with said opening such that said hinge line is discontinuous.

28. The binder device of claim 20 wherein said ring binding mechanism has a longitudinal dimension defined by a distance between an outer-most two rings or coils of said ring binding mechanism, and wherein said opening has a length at least as great as said longitudinal dimension, and wherein said opening has a depth dimension extending perpendicular to said longitudinal dimension, and wherein said opening has a depth dimension greater than a largest depth dimension of any said rings or coils.

29. The binder device of claim 20 wherein said first and second panels are pivotally coupled together in a spine region, and wherein the binder device further includes a cover flap pivotally coupled to said cover in said spine region, wherein said cover flap is positionable to entirely overlay said opening.

30. A binder device comprising:

a cover including a first panel and a second panel pivotally coupled together in a spine region of said binder device;

a binding mechanism coupled to said cover, said binding mechanism including at least two rings or coils spaced apart a predetermined distance, wherein said cover includes an opening that is continuous in a direction parallel to the predetermined distance, wherein the opening is in or adjacent to said spine region and has a length at least as long as said predetermined distance to provide access to said binding mechanism; and a cover flap pivotally coupled to said cover in said spine region, wherein said cover flap is positionable to at least partially overlay said opening.

31. The binder device of claim 30 wherein first and second panels are pivotally coupled along a hinge line and wherein said binding mechanism has a longitudinal dimension defined by a distance between an outer-most two rings or coils of said binding mechanism parallel to said hinge line, and wherein said opening has a length in a direction parallel to said hinge line at least as great as said longitudinal dimension.

32. The binder device of claim 30 wherein said first panel is pivotable about a hinge line, wherein said predetermined distance extends in a direction parallel to said hinge line, and wherein said length of said opening extends in a direction parallel to said hinge line.

33. The binder device of claim 30 wherein said binding mechanism has a longitudinal dimension defined by a distance between an outer-most two rings or coils of said binding mechanism, and wherein said opening has a length at least as great as said longitudinal dimension.

34. The binder device of claim 30 wherein said opening is a single opening that spans said at least two rings or coils when said cover is in a closed position.

35. The binder device of claim 30 wherein said opening has a depth dimension extending perpendicular to said pivot axis, and wherein said depth dimension of said opening is greater than a greatest depth dimension of said binding mechanism at any location of said binding mechanism extending in a same direction as said depth dimension of said opening.

36. The binder device of claim 30 wherein said binding mechanism includes at least two rings spaced apart the predetermined distance, and wherein each ring includes two ring portions that are movable between a closed position where each ring portion of one of said at least two rings engage each other to form a closed ring to trap items therein, and an open position where each ring portion of said one of said at least two rings are at least partially spaced apart so that items can be placed into or removed from the binding mechanism.

37. The binder device of claim 30 wherein said cover flap has generally the same size and shape as one of said first or second panels, and at least part of said cover flap is releasably attachable to said cover.

38. The binder device of claim 30 wherein the cover flap is directly pivotally coupled to the cover in the spine region, and wherein said cover flap is sized and shaped to entirely cover said opening.

39. The binder device of claim 19 wherein said first panel and said second panel are pivotally coupled along a hinge line, and wherein said longitudinal dimension of said binding mechanism and said length of said opening each extend parallel to said hinge line.

40. The binder device of claim 15 wherein said binder device is configured such that said first component is bindable to said binding mechanism and entirely positioned between said first and second panels while said second component, having a shape and size identical to a shape and size of said first component, is simultaneously bindable to said binding mechanism and at least partially not positioned between said first and second panels.

* * * * *